United States Patent [19]

Sandell

[11] 4,263,346

[45] Apr. 21, 1981

[54] METHOD FOR THE MANUFACTURING OF FIBRE REINFORCED BUILDING STRUCTURES SURFACE COATINGS

[76] Inventor: Bertil Sandell, Länsmansvägen 21, 430 80 Hovas, Sweden

[21] Appl. No.: 952,146

[22] Filed: Oct. 17, 1978

[30] Foreign Application Priority Data

Oct. 17, 1977 [SE] Sweden ..... 7711626

[51] Int. Cl.[3] ..... B05B 1/06; B05D 1/12

[52] U.S. Cl. ..... 427/196; 118/308; 239/1; 239/424; 427/426; 427/427

[58] Field of Search ..... 239/1, 10, 554, 419.3, 239/424, 422, 427.5, 428, 430, 431; 366/5, 10, 11, 40; 427/196, 426, 427; 118/308

[56] References Cited

U.S. PATENT DOCUMENTS

| | | | |
|---|---|---|---|
| 2,314,329 | 3/1943 | Ericson | 427/196 |
| 2,433,463 | 12/1947 | Lampe | 427/196 |
| 2,683,625 | 7/1954 | Fisher | 239/422 |
| 3,035,940 | 5/1962 | Hobson | 427/426 |
| 3,185,396 | 5/1965 | Black | 239/422 X |
| 4,050,677 | 9/1977 | Benthin | 366/11 |
| 4,095,748 | 6/1978 | Ohtake et al. | 239/419.3 |

FOREIGN PATENT DOCUMENTS

| | | |
|---|---|---|
| 2630132 | 1/1977 | Fed. Rep. of Germany . |
| 204999 | 3/1966 | Sweden . |
| 226031 | 4/1969 | Sweden . |
| 7507537 | 11/1977 | Sweden . |

*Primary Examiner*—Shrive P. Beck

*Attorney, Agent, or Firm*—Holman & Stern

[57] ABSTRACT

The present invention refers to a method and a device for the manufacture of fibre reinforced building structures, surfing coatings and similar, by spraying cement, concrete, mortar or the like through a spraying nozzle, at which disintegrated fibre- or rod-shaped reinforcing material is introduced into the spraying nozzle by means of pressure air. The reinforcing material is brought through a central passage extending through substantially the whole length of the spraying nozzle, and the structural material is brought through a passage in the spraying nozzle, which passage concentrically surrounds said central passage. In this way the reinforcing material will be surrounded by a casing of structural material during a substantial part of the transport from the nozzle to the land surface, thus avoiding the loss of any large quantities of reinforcing material.

7 Claims, 5 Drawing Figures

METHOD FOR THE MANUFACTURING OF FIBRE REINFORCED BUILDING STRUCTURES SURFACE COATINGS

The present invention relates to a method for the manufacturing of fibre reinforced building structures, surface coatings and the like by means of spraying of a structure material such as cement and/or lime-based materials, e.g. concrete, mortar or the like, at which a disintegrated fibre- or rod-shaped reinforcing material by means of compressed air is introduced into a spraying nozzle separated from the mixture of material.

When admixing the fibres, particularly steel fibre rods into concrete, said fibres have the pecularity to be stuck together (balling), by which a very uneven distribution of the fibre material is achieved. To avoid this disadvantage it has been suggested to introduce the reinforcing material to the concrete mixture in the spraying nozzle and not earlier, by which balling is prevented. By this method a very high-quality, impact resistant concrete is achieved, which, however, is relatively expensive compared to the concrete used at conventional pouring. Therefore, the method has its limits and also shows the disadvantage probably due to a number of different facts, such as the oblong shape of the fibres, the large amount of air and thus the air surplus required to transport the reinforcing material, and the tendency of the fibres to perform uncontrolled turbulent motions after leaving the nozzle.

The purpose of the present invention is to enable the use of a standard concrete compound, which can be pumped or in a similar way transported, together with for example steel fibers without the occurrence of balling effect. Another purpose of the invention is to enable the spraying of the concrete without wasting any large quantities of fibres. This has been achieved by the reinforcing material being introduced centrally through the nozzle and the material mixture being guided coaxially relative to the reinforcing material and essentially without mixing with this, through the nozzle, so that an outer casing of the material mixture is achieved outside the nozzle, said material mixture surrounding the reinforcing material during an essential part of the transport from the nozzle to the land surface.

The invention also relates to a spraying nozzle for performing of the method, which nozzle comprises a central flow passage for the reinforcing material, arranged to extend essentially through the whole nozzle, a ring-shaped passage for the material mixture, said passage concentrically surrounding the central flow passage, and the mouths of the passages are so designed that the material mixture surrounds the reinforcing material during an essential part of the transport from the nozzle to the land surface.

The invention will now be further described with reference to the enclosed drawings which show some embodiments.

Figure 1:
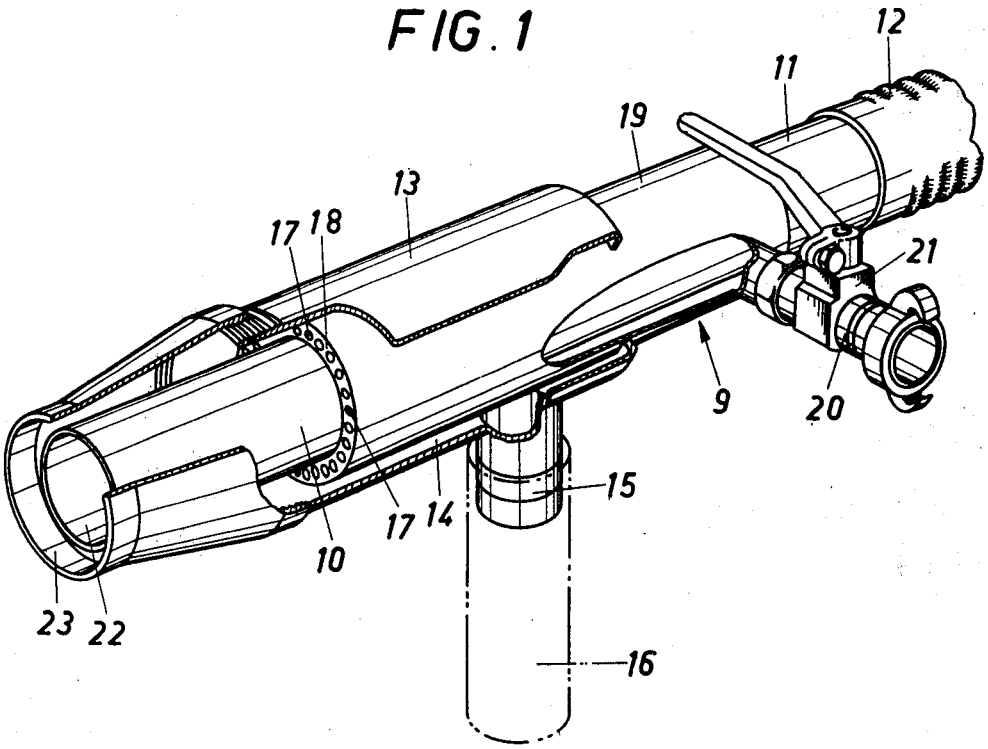
FIG. 1 illustrates in perspective a spraying nozzle according to the invention, partly in section.

The spraying nozzle 9 according to the invention consists of a central flow passage 10, extending essentially through the whole nozzle and at one end 11 connected to a pipe 12 for the reinforcing material. The central flow passage 10 is at some distance concentrically surrounded by an outer tube 13, forming a ring-shaped passage 14 between the flow passage and the inside of the tube. A pipe socket 15 is connected to the tube 13 and serves as a connection for a pipe 16 for a material mixture such as concrete, mortar or the like. To increase the outflow speed of the material mixture there are arranged compressed-air nozzles 17 in the ring-shaped passage 14, which nozzles in the embodiment shown in FIG. 1 consist of a number of holes made in an end wall 18 of a tube 19 surrounding the central flow passage 10 at a less distance than the tube 13. The tube 19 is provided with a connecting brach 20 and a stop and control valve 21 for compressed air. The nozzles 17 are located so that a number of axial compressed-air streams are achieved, which are directed in the feeding direction of the material mixture. The nozzles 17 are located at a comparatively large distance from the mouth 22 of the central flow passage 10, so that the material mixture can be accelerated a considerable distance before it leaves the mouth 23 of the spraying nozzle.

Figure 2:
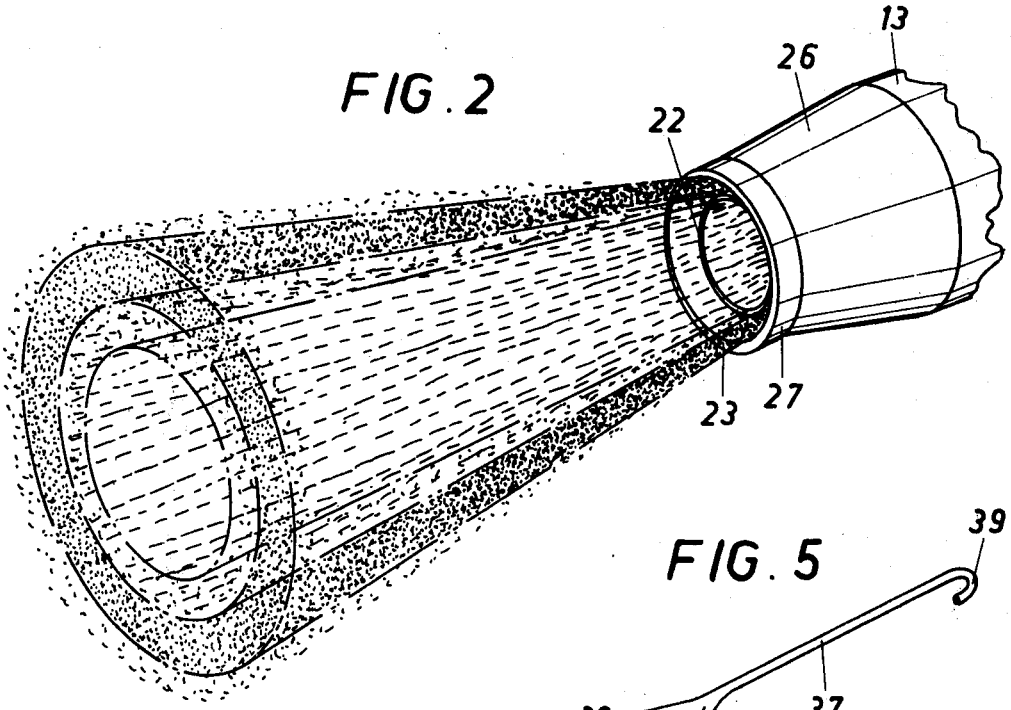
FIG. 2 shows, also in perspective, the mouth of the spraying nozzle according to FIG. 1 and the scattering picture of the sprayed-out reinforcing material and the material mixture.

To achieve the desired effect, the mouths 22 and 23 are so designed that the material mixture outside the nozzle form an outer casing around a core of reinforcing material. This has been schematically illustrated in FIG. 2. In this connection it is important that the amount of air that transports the reinforcing material is balanced to the amount of air required to transport the material mixture in a way that the reinforcing material during an essential part of the covered air distance to the land surface is surrounded by the material mixture. To achieve this balance said stop and control valve 21 is arranged in the connecting branch 20, said valve allowing a control of the amount of air for the discharging of the material mixture from the nozzle.

Figure 3:
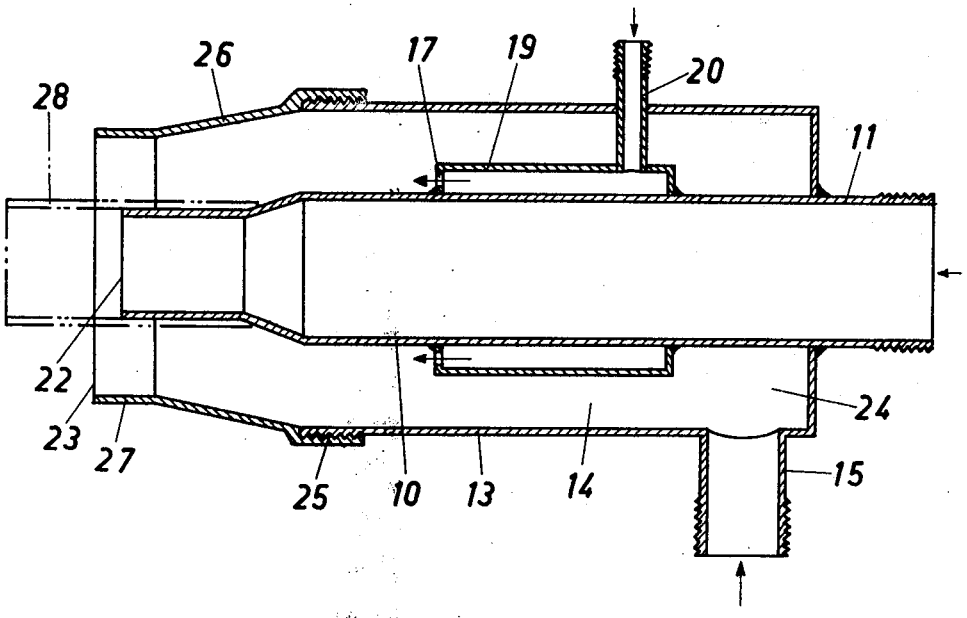
FIG. 3 shows a longitudinal section through a modified embodiment of the spraying nozzle according to FIG. 1.

The embodiment shown in FIG. 3 essentially corresponds with the one showed in FIG. 1. The feed of the material mixture via the pipe socket 15 is done through a collecting passage 24 with a larger cross section area than the passage 14 closest to said collecting passage 24. Thus a good distribution of the material mixture round the whole central tube 10 and an even discharging to the passage 14 are achieved. The section increase of the ring-shaped passage 14 has been achieved by means of the tube 19, which, however, has a comparatively short length contrary to the embodiment according to FIG. 1. At the front end of the outer tube 13 there are preferably arranged threads 25 for connection of a detachable nozzle 26. This is at its mouth preferably designed with a cylindrical portion 27, which also can have a less section than the tube 13 so that the speed of the material mixture is increased in the nozzle. Also the central tube 10 can at the area around the mouth have a section reduction to achieve an increased speed of the reinforcing material.

To be able to adapt the spraying nozzle to different kinds of material mixtures and reinforcing materials, it is possible to apply spraying nozzles 26 of different lengths, the mouth of which can be located outside the mouth of the central tube, as shown in FIG. 3, but the nozzle 26 can also be shorter, so that the mouths 22 and 23 coincide or that the mouth 22 is located outside the mouth 23. It is also possible to apply an extension pipe to the front end of the central tube 10, whereby you achieve that the outflow of the reinforcing material is kept together during a somewhat longer distance, so that the possible tendency of the fibres to pierce the casing of the material mixtures is further reduced.

Figure 4:
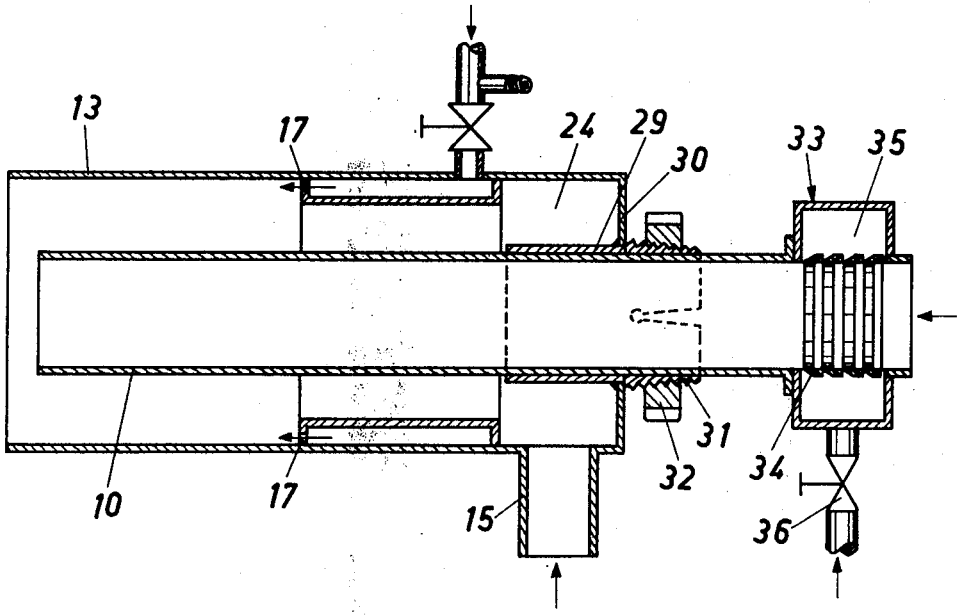
FIG. 4 shows a longitudinal section of another embodiment.

At the embodiment according to FIG. 4 the nozzles 17 and the compressed-air passage are arranged at the inside of the outer tube 13, and by this the material mixture flow can be displaced along the inner central tube 10.

In this embodiment the central tube 10 is displaceably arranged along a sleeve 29, the part 35 of which, located outside the end wall 30, is adjustable by means of a nut 32, by which the position of the central tube in the outer tube 13 can be fixed.

In front of the intake of the central passage 10 a device may be arranged to reduce the air surplus in the air flow, which transports the reinforcing material. Such a device 33 is shown in FIG. 4 and consists of a great number of gill-shaped openings 34 located in an extension of the central passage. The openings 34 debouch into a space 35, which via a valve 36 communicates with the atmosphere. By opening the valve more or less a larger or smaller quantity of the air flow can be evacuated, so that the air surplus at the mouth 22 of the central passage has been reduced to an absolute minimum.

Figure 5:
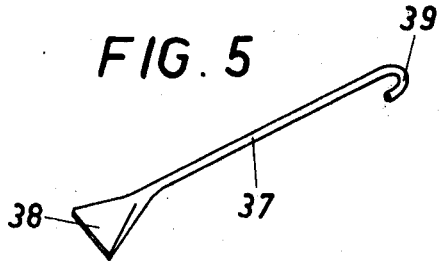
FIG. 5 shows a reinforcing rod in perspective.

Practical tests have proved that the reinforcing material after the exit from the mouth 22 to a certain extent loses its orientation in the direction of the air flow and this results in the fact that the steel fibre rods perform uncontrolled turbulent motions, what may lead to the fact that part of the reinforcing material pierces the surrounding casing of the material mixture. In order to avoid this it has proved to be favourable to design each specific steel fibre rod 37 in a way that it obtains better aerodynamic characteristics, and this can be done by designing the rod for instance with a fin 38 at one end, which in the shown embodiment, FIG. 5, is achieved by flattening one end of the rod. In order to achieve a good anchorage into the concrete material the opposite end is preferably designed with a flanged portion 39 of such a shape that a hooking together of several rods is avoided. The steel fibre rod 37 can naturally be designed in many different ways, e.g. with a wave-shaped rib. Instead of being flanged it can be designed like a head. The steel fibres can be made of a rod-shaped material, but of a tape-shaped as well, and in order to further increase the adhesion the tape can be provided with transversal ridges or the like.

At the tests performed on a smaller scale, the fibre waste descreased essentially at the same time as the fibre proved to have a certain combining effect on the concrete when this had been applied on to the mould surface. This was of great interest as at wet spraying it has earlier been necessary to compensate the comparatively wet mass with an admixture of a large amount of accelerator (in the nozzle). This accelerator admixture, which means deteriorated tensile properties, might then be reduced or left out, thus eliminating one of the disadvantages of the wet-spraying method.

In connection to the above-mentioned spraying tests, some test plates with different water cement ratio and fibre contents were sprayed, which plates in respect of the bending-tensile strength had been tested at the National Swedish Institute for Materials Testing. The test was performed on beams 80×10×15 cm. The results are reported in table 1. The fibre reinforcing was made of end-hooked fibres 35×0.35 mm.

TABLE 1.

| | | Specification of test results | | | |
|---|---|---|---|---|---|
| | Mixing Proportion | Water | Fibre | Bending-Tensile strength 28 days and nights | |
| Beam No | (proportioning by weight) | Cement ratio | Content (Volume %) | Cracking Stress(MPa) | Breaking Stress(MPa) |
| I A | 1:3.35 | 0.87 | 0 | 4.85 | 4.85 |
| I B | 1:3.35 | 0.87 | 0 | 4.67 | 4.67 |
| I C | 1:3.35 | 0.87 | 0 | 4.64 | 4.64 |
| I D | 1:3.35 | 0.87 | 0 | 4.76 | 4.76 |
| II A | 1:3.35 | 0.87 | 1.0 | 4.50 | 7.90 |
| II B | 1:3.35 | 0.87 | 1.0 | 4.80 | 7.58 |
| II C | 1:3.35 | 0.87 | 1.0 | 4.30 | 7.75 |
| II D | 1:3.35 | 0.87 | 1.0 | 4.40 | 7.29 |
| III A | 1:3.35 | 0.77 | 1.0 | 4.20 | 7.56 |
| III B | 1:3.35 | 0.77 | 1.0 | 5.20 | 9.96 |
| III C | 1:3.35 | 0.77 | 1.0 | 5.10 | 9.35 |
| III D | 1:3.35 | 0.77 | 1.0 | 4.50 | 9.02 |
| IV A | 1:3.0 | 0.55 | 1.2 | 5.30 | 7.49 |
| IV B | 1:3.0 | 0.55 | 1.2 | 6.20 | 10.27 |
| IV C | 1:3.0 | 0.55 | 1.2 | 5.90 | 9.73 |
| IV D | 1:3.0 | 0.55 | 1.2 | 6.50 | 10.96 |

EXPERIMENTAL CONDITIONS AND TESTS

Material and Composition

Cement—Standard Portland Cement

Ballast—Natural Sand 0–4 mm.

The sprayed concrete has been composed by cement and sand in the weight proportions 1:3. The quantity of cement 475 Kg/m$^3$. Water Cement ratio about 0.55.

Admixtures—With a view of improving the consistency air-entraining and water-reducing admixtures have been used. The amount of admixtures has been about 1% of the cement weight.

In those cases, where accelerator has been used, this has been of alkali-silicate type. The stated percentage refers to % of the cement weight.

Steel fibres—The fibre reinforcing has in occurring cases been made of end-hooked steel fibres 35×0.35 mm. breaking stress about 1200 N/mm$^2$. (Aspect ratio 1/d=100).

Equipment and Manufacture

The concrete was manufactured by means of a 150-liter-force mixer.

The concrete mass was pumped to the spraying nozzle, where the pressure air and, in occurring cases, accelerator are added. The fibres were mixed into the concrete in the spraying nozzle by means of a defibrator (U.S. Pat. No. 4,092,737). The accelerator was added to the concrete via a pressure vessel by the pressure air.

Summary and Conclusions

From the obtained results one can conclude that wet-spraying in combination with steel fibre admixture in the nozzle is a better production method regarding fibre waste and achieved strengths than those practised so far.

Compared to the results, which are reported in Sweden, the test results are strikingly so much better that, inspite of variations of the experimental conditions, one dares to make such a conclusion. Thus has the bending-tensile strength at 28 days and nights been doubled, broadly speaking, compared with earlier investigations. This also goes for the short-time strength. At 1 day and night for example, the average is as high as 15.8 MPa (at $v \times 1/d = 110$ and with 5% accelerator admixture).

The primary cause is that the comparatively wet mass, containing little air, catches the fibres better in the spraying phase and embraces them better in the finished product.

The high strengths, which have been obtained, however, cannot only be related to the wet-spraying method as such. The composition of the used die, high cement content and relatively little grain size, is better adapted to fibre concrete than the ones used earlier and also suits the wet-spraying method better than the dry-spraying method. At bending-tensile testing many fibres have been pulled in two and this is unusual. Normally the adhesion between fibres and die is such that the fibre is drawn out of the die.

It is worth noticing that an accelerator admixture of 5% of the cement weight in all investigated respects affect the fibre concrete positively, while the plain concrete, as expected, show inferior values with accelerator admixture.

The investigation confirms the earlier known fact that a high value of $v \times 1/d$ (volume fibre × fibre length/fibre diameter) results in good tension-mechanical properties.

In one of the test plates the quantity of fibre has amounted to 1.8 volume percent ($v \times 1/d = 180$). The average for the bending-tensile strength for this test was as high as 30.4 MPa. In practice such a large quantity of fibres might not be advisable, as compacting difficulties will arise mainly at a high value of 1/d.

The impact value at 1.4% fibres is 5.5 times higher than without fibre admixture. Compared with earlier performed impact value tests on prisms, executed according to the dry-spraying method, the value is about two times higher than at the wet-sprayed tests.

Regarding the adhesion to rocks the results show a great spreading mainly due to variations of the mineralogical compound and structure of the ground. On a ground of limestone the fibre concrete shows better results, in other cases the results are more difficult to judge, as fractures have often arisen in rocks or concrete. The adhesion is probably not affected by the fibre admixture. A somewhat less shrinkage of the fibre concrete may counteract shear stresses in the boundary layer between rock and concrete and this may have a positive effect.

The compression strength perpendicular to the fibre direction is somewhat better for fibre concrete than for plain concrete, and this is owing to the fact that the transverse tensions, which arise at testing of cubes, are carried by the fibre reinforcement.

The difference in shrinkage between specimens with and without fibres is small. This is probably due to the fact that the quantity of fibre material is low and that the stiffness of the fibre has only a very moderate effect upon the free shrinkage.

The water penetration has proved to be larger at fibre reinforced specimens, which is probably due to coherent discontinuities along the fibre surfaces. In all cases, however, the tests have been waterproof according to Swedish government concrete regulation B5.

Regarding the keeping together of the fresh concrete the investigation shows a clearly positive effect of the fibre admixture. On the other hand the adhesion is not improved between fresh concrete and the grounds, which have been used at the test sprayings. The favourable effect of the fibre as to the keeping together makes it possible to reduce or to leave out the accelerator. The quantity of fibre waste varies much owing to the spraying direction, the state of the ground, quantity of pressure air etc. and can vary between 5 and 20%.

What I claim is:

1. A method of spraying a reinforced cementitious building material onto a surface from a spraying nozzle comprising creating a first central stream in the nozzle of reinforcing fillaments, creating a second stream in the nozzle of cementitious building material, said second stream substantially entirely surrounding said first stream and said first and second streams being substantially coaxial and being paralleled as the streams leave the nozzle, maintaining the integrity of said streams within the nozzle and releasing said streams from the nozzle with said second stream being discharged through an annular orifice co-axially surrounding the discharge opening of said first stream so as to continue maintaining the integrity of streams for a substantial part of their travel towards said surface.

2. The method of claim 1 including the step of mixing compressed air with said second stream within the nozzle.

3. The method of claim 1 wherein said filaments comprise metal filaments.

4. The method of claim 1 including the step of accelerating the second stream within the nozzle.

5. The method of claim 4 wherein compressed air is mixed with said building material within the nozzle to accelerate said second stream.

6. The method of claim 5 wherein said compressed air is caused to flow substantially axially through the nozzle.

7. The method of claim 1 including the step of accelerating said first stream within the nozzle.

* * * * *